United States Patent [19]

Hansotte

[11] 4,332,092

[45] Jun. 1, 1982

[54] PROCESS AND APPARATUS FOR DESOLVENTIZING AND DRYING SOLVENT WET MATERIALS

[75] Inventor: Roger J. Hansotte, Butler, Pa.

[73] Assignee: Dravco Corporation, Butler, Pa.

[21] Appl. No.: 190,428

[22] Filed: Sep. 24, 1980

[51] Int. Cl.[3] ..... F26B 3/14

[52] U.S. Cl. ..... 34/27; 34/35; 34/65; 34/86; 34/169; 260/428.5

[58] Field of Search ..... 426/417, 478, 511, 456; 260/428.5; 34/77, 36, 37, 35, 86, 168, 169, 171, 172, 173, 27, 32, 13, 65, 66

[56] References Cited

U.S. PATENT DOCUMENTS

| | | | |
|---|---|---|---|
| 2,778,123 | 1/1907 | Kurtz | 34/173 |
| 2,806,297 | 9/1957 | Hutchins | 34/173 |
| 2,811,539 | 10/1957 | Karnofsky | 34/173 |
| 3,057,077 | 10/1962 | Depmer | 34/173 |
| 3,126,285 | 3/1964 | Lippold | 34/173 |
| 3,367,034 | 2/1968 | Good | 34/36 |
| 3,392,455 | 7/1968 | Kingsbaker, Jr. et al. | 34/36 |
| 3,649,294 | 3/1972 | Thijssen | 426/417 |

*Primary Examiner*—Larry I. Schwartz

*Attorney, Agent, or Firm*—Louis E. Marn; Elliot M. Olstein

[57] ABSTRACT

There is a disclosed a process and apparatus wherein a solvent-enriched material is introduced into a desolventizer-toaster tower to form a desolventized material which is introduced into a dryer and heated in the absence of air to form a dried material and a vapor steam including solvent which is compressed and passed to the desolventizer-toaster tower to provide all or a portion of the sparger steam requirements therefor.

11 Claims, 1 Drawing Figure

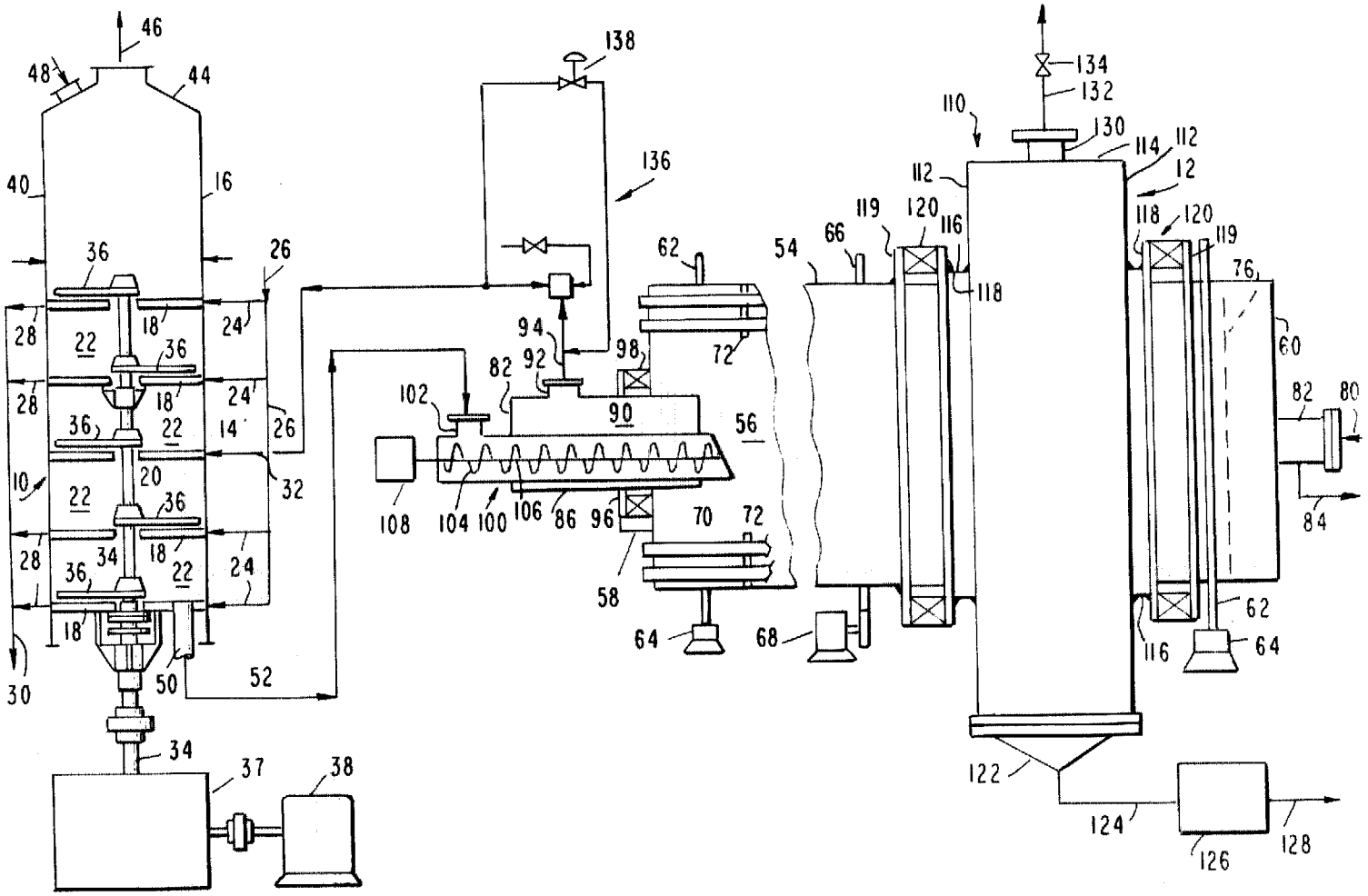

PROCESS AND APPARATUS FOR DESOLVENTIZING AND DRYING SOLVENT WET MATERIALS

FIELD OF THE INVENTION

This invention relates to a process and apparatus for heating a bulk material to separate a vaporizable material thereof, and more particularly to a process and apparatus for desolventizing and drying of solvent-extracted materials, particularly solvent-extracted oleaginous seed materials.

BACKGROUND OF THE INVENTION

Oleaginous seed materials, such as soybeans, cottonseeds peanuts, sesame seeds, sunflower seeds, rapeseed, and the like contain proteinaceous matter of a highly nutritious nature. Soybeans for example, after oil extraction, have been treated to recover the proteinaceous matter for use in diverse industrial processes, e.g. in the papers, plastic and food industries. Without limitations as to other uses, the invention will be herein particularly described in connection with the extraction of oil from soybeans.

In the processing of seeds to extract oil by solvent extraction, the seeds are crushed or milled into cake or flakes or otherwise fragmentized and treated with a solvent to extract the oil, leaving meal in which vaporizable solvent remains. By heating the meal, using steam both indirectly through a heated surface and/or directly by steam contacting the meal, the solvent is vaporized while the meal itself is cooked or toasted to carmelize carbohydrates, to deactivate certain enzymes and to denature proteins thereby to produce an edible substance.

Apparatus for vaporizing the solvent so that it might be recovered while simultaneously and/or subsequentially toasting the extracted seed is well known in the art as illustrated, for example, in the U.S. Pat. Nos. 1,112,128; 2,577,010; 2,585,793; 2,695,459; 2,806,297; 3,018,564; and 3,359,644. As disclosed in these patents, the material from which solvent is to be removed progresses downwardly as a bed through a column which is provided with spaced horizontal plates therein dividing the interior of the column into a vertical series of compartments. In these compartments, the material is heated and agitated and the finished material discharged from the bottom of the column.

A solvent is removed as an overhead vapor from the column which is then condensed. Present desolventizing practice include the introduction of steam directly into the desolventizer toaster tower or column from a boiler via suitable piping including valves, orifices, etc., to reduce the pressure of the steam to that necessary for sparging the bed to accomplish desolventizing operations, i.e. steam flows into the flakes on the trays through holes provided in the sparge tray, the sparge arms or like devices. The sparger steam condenses on the flakes while vaporizing the bulk of the hexane and providing the sensible heat to raise the temperature of the flakes to about 190° to 205° F. Such temperatures are adequate to denature the proteins and deactivate the enzymes provided adequate residence times are attained during passage of the meal through the desolventizer-toaster tower and drying apparatus.

Generally, the moisture content of soymeal exiting the desolventizer-toaster tower is from 17 to 25 percent by weight dependent on the temperature of the discharged meal. Since commercially saleable animal soymeal feed should contain not more than about 12 percent by weight moisture, external drying is generally effected on the desolventized-toasted soy meal in commercially available rotary drum type apparatus having large indirect heat transfer surface per unit volume. Traces of solvent vapor are discharged from the dryer into the atmosphere and are considered a pollutant subject to environmental consideration via the Clean Art Act. Additionally, the desolventizer-toaster operation is usually performed in expressive equipment requiring, inter alia, considerable energy, steam and electrical power. Additionally, there are requirements for considerable amounts of make-up to the recycle solvent stream, etc.

OBJECTS OF THE INVENTION

It is the object of the present invention to provide a novel process and apparatus for desolventizing and drying a solvent wet material.

Another object of the present invention is to provide a novel process and apparatus for desolventizing and drying a solvent extracted oleaginous seed meal.

A further object of the present invention is to provide a novel process and apparatus for desolventizing and drying a solvent extracted oleaginous seed meal with reduced energy requirements.

A still further object of the present invention is to provide a novel process and apparatus for desolventizing and dyring a solvent extracted oleaginous seed meal with reduced steam requirements.

Still another object of the present invention is to provide a novel process and apparatus for desolventizing and drying a solvent extracted oleaginous seed meal wherein the desolventizer-toaster tower is of reduced size.

A still further object of the present invention is to provide a novel process and apparatus for desolventizing and drying a solvent extracted oleaginous seed meal of reduced solvent losses to the atmosphere with concomitant savings in make-up solvent requirements.

SUMMARY OF THE INVENTION

These and other objects of the present invention are achieved by a process and apparatus wherein a solvent-enriched material is introduced into a desolventizer-toaster tower to form a desolventized material (containing traces of solvent) which is introduced into a drum dryer and heated in the absence of air to form a dried material and a vapor steam including solvent which is compressed and passed to the desolventizer tower to provide all or a portion of the sparger steam requirements therefore.

BRIEF DESCRIPTION OF THE DRAWING

A better understanding of the present invention as well as other objects and advantages thereof will become apparent upon consideration of the detailed disclosure thereof, especially when taken with the accompanying drawing which is a partially schematic and fragmentary view of the process and apparatus for desolventizing solvent wet material, such as soymeal by the solvent extraction of soybeans.

DETAILED DESCRIPTION OF THE INVENTION

It is to be understood that certain equipment, such as valves and indicators, and the like have been omitted from the drawing to facilitate the description hereof and the placing of such equipment at appropriate places is deemed to be within the scope of those skilled in the art.

Referring now to the drawing, there is illustrated a desolventizer-toaster tower or column and rotary drum dryer, generally indicated as 10 and 12, respectively. The desolventizer toaster tower 10 includes a hollow shell 14 generally cylindrical in shape forming a vertical column divided horizontally by steam-heated trays 18 and a center-most sparger tray 20 into a vertical series of compartments 22. Each of the trays 18 has an opening or chute (now shown) through which bulk material is passed downwardly from one compartment 22 to the next compartment in a controlled manner. Steam is introduced into the trays 18 by line 24 from steam manifold 26 with condensate being withdrawn in line 28 to a condensate manifold 30. Sparger steam including vapors in line 32, as more fully hereinafter discussed, is introduced into the sparger tray 20 including sparger orifices.

Centrally disposed in the desolventizer-toaster tower 10, there is provided a vertical shaft 34 provided with arms 36 which sweep around and over the trays 18 and 20 to agitate the material thereon. The shaft 34 is driven via a reduction gear 37 by a motor 38. The upper portion 16 of the desolventizer-toaster tower 10 above the uppermost compartment 20 is provided with a dome-shaped portion 40 and enclosed by a roof portion 44 including a vapor outlet 46 in vapor communication with a solvent recovery unit (not shown) as known to one skilled in the art.

Material to be treated in the desolventizer-toaster tower 10 is introduced through a solids inlet conduit 48 with a solids outlet chute 50 provided for withdrawing desolventized solvent-wetted meal for passage via a conduit 52 to the rotary drum dryer 12. The conduit 52 includes solid's convey means, such as rotating auger of known design disposed in a housing (not shown) to convey the desolventized meal under a vapor sealed condition.

The rotary drum dryer includes an elongated dryer vessel 54 of cylindrical configuration defining a drying zone 56 with end wall 58 at the inlet end and an end wall 60 at the opposite end thereof and is downwardly inclined from the inlet end to thereby continuously convey therethrough the material being treated in the drum dryer. About the vessel 54, there are provided a plurality of support rings 62 mounted for rotation on a plurality of trunnion support assemblies, generally indicated as 64. At least one drive ring gear 66 is mounted about the dryer vessel 54 and is driven by a gear and motor assembly, generally indicated as 68.

The rotary drum dryer 12 is of the indirectly steam heated type and includes a plurality of steam tubes, generally indicated as 70 running the full length of the vessel 54 symmetrically disposed through a plurality of spaced-apart disc-shaped ring members 72 (one shown). The tubes 70 are rigidly fastened to a sheet member 76 forming a steam chamber 78 with the end wall 60 of the drum vessel 54 at the discharge end of the dryer 12, and are supported at the other end by seal plate assemblies (not shown) to permit thermal expansion. The tubes are continuously vented at the ends extending through the end wall 58 to prevent accumulation of non-condensibles. A steam inlet line 80 is in fluid communication via fitting 82 with the manifold chamber 78 with a line 84 provided to withdraw condensate forming a rotary joint, as is known to one skilled in the art.

The inlet end of the rotary drum dryer 12 is provided with a cylindrically-shaped member 86 having an end wall 88 concentrically disposed with the vessel 54 and extending through the end wall 58 of the vessel 54 thereby forming a vapor chamber, generally indicated as 90. An upper portion of the cylindrically-shaped member 86 is provided with a vapor outlet fitting 92 in fluid flow communication with a conduit 94. A disc-shaped ring member 96 is mounted to the outer surface of the cylindrically-shaped member 86 and forms a vapor-tight seal with the end wall 58 of the vessel 54 by a vapor sealing assembly, generally indicated as 98.

Extending through and mounted to the end wall 88 of the cylindrically-shaped member 86 forming the vapor chamber 90, there is provided a solids housing conveyer assembly, generally indicated as 100 having a solids inlet fitting 102 and an auger 104 mounted on a shaft 106 driven by drive means, generally indicated as 108. The solids inlet fitting 102 is in solid flow communication with solids conveying conduit 52.

The rotary drum dryer 12 is provided with a vapor-solids outlet assembly, generally indicated as 110, comprised of parallelly-disposed, disc-shaped plate members 112 mounted, such as by welding, to shaped outer plate member 114 and cylindrically-shaped inner plate members 116, the other ends of which are mounted, such as by welding, to disc-shaped members 118 forming a vapor tight seal with disc-shaped member 119 welded to vessel 54 by vapor seals, generally indicated as 120. The lower portion of the vapor-solids outlet assembly 110 is formed with an outlet chute 122 in vapor sealed relationship with solids conduit 124 to a solids cooler, generally indicated 126, having a solids discharge conduit 128.

The vapor-solids outlet assembly 110 is provided with a vapor outlet fitting 130 in fluid communication with conduit 132 under control of valve 134 as an alternate atmospheric vapor outlet for the rotary drum dryer 12.

The vapor conduit 94 is in fluid communication via a steam ejector assembly, generally indicated as 136, for pressurizing the vapor withdrawn from the rotary drum dryer 12 to the pressure level required for introduction by line 32 into the desolventizer-toaster tower 10. The pressure level within the drying zone 56 is controlled within a preset range by valve 138 (underpressure) and valve 134 (overpressure).

In operation, solvent wetted material, such as soymeal from a solvent extractor unit utilizing hexane to extract soybean oil from full fatted soy flakes is introduced into the desolventizer-toaster tower 10 by line 48. Steam from manifold 26 at a temperature and pressure of from 335° to 370° F. and 100 to 150 psig. respectively, is introduced by lines 24 into the steam trays 18. Steam including solvent vapors at a pressure of from 1 to 15 psig. in line 32 is introduced into the sparger tray 20 of the desolventizer-toaster tower 10 to provide the sparger steam requirements therefor. The meal is heated to a temperature of about 190° to 205° F. by condensation of the steam whereby the bulk of the hexane is vaporized from the soybean meal and the moisture content raised to about 15 to 25 weight percent. The residence time of the meal during passage through the desolventizer-toaster tower 10 is about 15 to 30 minutes, sufficient to deactivate certain enzymes and denature the protein matter.

Soy meal having a hexane and moisture content of about 500 to 7500 ppms and 17 to 25 weight percent, respectively, is withdrawn at a temperature of about 215° to 220° F. by line 52 and is passed to the solids inlet 102 of the solids conveyor housing conveyor assembly 100 of the rotary drum dryer and conveyed into the drying zone 56. Steam in line 80 is introduced into the steam inlet fitting 82 of the rotary drum dryer 12 and into the tubes 70 via the manifold chamber 78 to heat the drying zone 56 to a temperature sufficient to raise the temperature of the meal to about 222° to 240° F. Condensate collecting in the tubes 70 is withdrawn through line 84. During passage through the rotary drum dryer 12, the meal is dried to a moisture content of about 11.5 to 14 weight percent with a residual hexane content from 300 to 380 ppm. respectively. The dried meal is withdrawn by line 124 from the rotary drum dryer 12, cooled in cooler to a temperature of about 10° to 20° F. above ambient and is passed by line 128 to storage or processing facilities (not shown). In accordance with the instant invention significant hexane vapor is recovered from the drum dryer vapor effluent for reuse in the extraction portion of the plant as distinguished from the venting thereof as presently practiced. Additionally, steam requirements are significantly reduced.

It will be appreciated that an existing desolventizing tower and drum dryers may be modified in accordance with the present invention, i.e. to include appropriate tray and arm assemblies, conduit configurations and required seals for operation in a vapor sealed relationship of the drum dryer 12 and the absence of air.

Operation of the process and apparatus of the present invention is described in the following specific example which is intended to be merely illustrative and the present invention is intended not to be limited thereto.

EXAMPLE

Soymeal from an extraction unit treating 2,000 tons per day of full fatted soybeans is introduced by line 48 into the desolventizer-toaster tower 10. Steam at a temperature and pressure of 366° F. and 150 psig. is introduced by lines 24 from a manifold 26 into the steam trays 18. A vapor stream having trace quantities of hexane in line 32 at a temperature and pressure of 240° F. and 5 psig. is introduced into the sparger tray 20. The soymeal is heated to a temperature of about 205° F. by condensation with a major portion of the hexane being vaporized from the soymeal.

Soymeal having a hexane and moisture content of about 800 ppm and 20 weight percent is withdrawn from the desolventizer-toaster tower 10 by line 52 and is introduced into the rotary drum dryer 12. The soymeal is heated to a temperature of 224° F. whereby the hexane and moisture content of the soymeal is reduced to 300 ppm and 11.5 weight percent, respectively. About 300 tons per year of hexane is recovered which otherwise would be vented to the atmosphere. Additionally, savings in steam requirements amounted to about 95 lbs./ton of soybean processed as compared to desolventized and drying process and apparatus operated in the conventional manner.

While the embodiment of the present invention has been discussed with reference to a desolventizer-toaster tower as including perforated sparger tray and the treatment of oleaginous seed materials, it will be understood that the principle of the present invention is applicable to any of desolventizer-toaster tower having a shaft including rotating members wherein steam is directly introduced into the meal, e.g. by rotating sparger arms, as well as any solvent extract material. Additionally, it will be understood that the principle of the present invention is applicable to any type of dryer (i.e. microwave, ultrasonic, etc.) in which the drying operation is performed in the absence of air, with the recovered vapors for reuse in the desolventizing apparatus. Still further, it will be understood that the principle of the present invention is applicable to any type of vapor compressor (i.e. centrifugal, piston, etc.) as an alternate to the steam ejector assembly. The present invention discloses the use of a vertically disposed, cylindrically-shaped desolventizer-toaster, however, the principle of the present invention is applicable to any type of desolventizer where sparge steam is contacted directly with a solvent wet material.

While the invention has been described in connection with an exemplary embodiment thereof, it will be understood that many modifications will be apparent to those of ordinary skill in the art; and that this application is intended to cover any adaptations or variations thereof. Therefore, it is manifestly intended that this invention be only limited by the claims and the equivalents thereof.

What is claimed:

1. A process for desolventizing a solvent extracted material to improved solvent recovery which comprises:

(a) introducing said material into desolventizer zone maintained at a desolventizing temperature;

(b) introducing a vapor stream including steam and solvent vapors into said desolventizer zone for direct contact with said material to effect desolventizing of said material with concomitant increase in the moisture content thereof;

(c) withdrawing a vapor including vaporized solvent from said desolventizer zone;

(d) withdrawing desolventized material from said desolventizer zone;

(e) introducing said desolventized material into a drying zone for heating said desolventized material in the absence of air to a temperature sufficient to reduce the moisture and solvent content thereof;

(f) withdrawing dried solid material from said drying zone; and (g) withdrawing and compressing a vapor stream from said drying zone, said compressed vapor stream constituting at least a portion of said vapor stream of step (b).

2. The process as defined in claim 1 wherein said solvent extracted material is obtained by the solvent extraction of oleaginous seed materials.

3. The process for desolventizing a solvent extracted material as defined in claim 2 wherein said solvent extracted material is hexane extracted soybean meal.

4. The process for desolventizing a solvent extracted material as defined in claim 2 or 3 wherein desolventizing is effected at a temperature of from 190° to 205° F.

5. The process for desolventizing a solvent extracted material as defined in claim 4 wherein drying is effected at a temperature of from 222° to 225° F. whereby the moisture content of said dried meal is reduced to 11.5 to 14 percent by weight.

6. The process for desolventizing a solvent extracted material as defined in claims 2 or 3 wherein drying is effected at a temperature of from 222° to 225° F. whereby the moisture content of said dried meal is reduced to 11.5 to 14 percent by weight.

7. The process for desolventizing a solvent extracted material as defined in claim 1 wherein said vapor stream of step (g) is compressed to from 1 to 15 psig.

8. An improved apparatus for desolventizing and drying a solvent extracted material including a desolventizer-toaster vessel having conduit means for introducing steam in direct contact with said solvent extracted material, the improvement characterized by:

a vapor-sealed rotary drum dryer vessel;

conduit means for withdrawing and introducing desolventized material from said desolventizer-toaster vessel into said rotary drum dryer vessel;

means for heating said rotary drum dryer in the absence of air of effect a reduction in the moisture content of said desolventized material;

conduit means for withdrawing a vapor stream including solvent vapors from said rotary drum dryer;

compressor means for compressing said vapor stream;

conduit means for introducing said compressed vapor stream into said desolventizer-toaster vessel in direct contact with said solvent extracted material; and conduit means for withdrawing dried desolventized material from said rotary drum dryer.

9. The apparatus for desolventizing a solvent extracted material as defined in claim 8 wherein said compressor means compresses said vapor stream to a pressure of from 1 to 15 psig.

10. The apparatus for desolventizing a solvent extracted material as defined in claim 8 wherein said desolventizer-toaster vessel includes a plurality of trays and wherein said compressed vapor stream is introduced into an intermediate tray of said desolventizer-toaster vessel, said tray being provided with orifices.

11. The apparatus for desolventizing a solvent extracted material as defined in claim 8 and further including a cooler means to cool said dried material.

Reconsideration and allowance of this application is respectfully solicited in view of the foregoing amendment to the claims and the following remarks.

* * * * *